US006842920B1

(12) United States Patent
Branch, III

(10) Patent No.: US 6,842,920 B1
(45) Date of Patent: Jan. 18, 2005

(54) ARCHED HAMMOCK STAND

(75) Inventor: Jesse A. Branch, III, Winterville, NC (US)

(73) Assignee: Hatteras Hammocks, Inc., Greenville, NC (US)

( * ) Notice: Subject to any disclaimer, the term of this patent is extended or adjusted under 35 U.S.C. 154(b) by 0 days.

(21) Appl. No.: 10/719,497

(22) Filed: Nov. 24, 2003

(51) Int. Cl.[7] ..... A45F 3/22; A45F 3/24
(52) U.S. Cl. ..... 5/128; 5/121; 5/127
(58) Field of Search ..... 5/128, 127, 121, 5/120, 113, 414; 135/96, 117

(56) References Cited

U.S. PATENT DOCUMENTS

| | | | | | |
|---|---|---|---|---|---|
| 298,515 | A | * | 5/1884 | Sutphen | 5/128 |
| 769,913 | A | * | 9/1904 | Noble | 5/128 |
| 811,166 | A | * | 1/1906 | Nuessen | 5/128 |
| 957,644 | A | * | 5/1910 | Berger | 135/144 |
| 1,011,789 | A | * | 12/1911 | Hoffman | 5/129 |
| 1,054,251 | A | * | 2/1913 | Stone | 5/128 |
| 1,062,950 | A | * | 5/1913 | Boss | 5/121 |
| 1,097,941 | A | * | 5/1914 | Rector | 5/129 |
| 2,353,220 | A | * | 7/1944 | Charlop | 5/128 |
| 4,229,845 | A | * | 10/1980 | de Cuadros | 5/127 |
| 4,757,563 | A | * | 7/1988 | An | 5/121 |
| 5,035,012 | A | * | 7/1991 | Westrich | 5/139 |
| 5,046,203 | A | * | 9/1991 | de Cuadros | 5/128 |
| 5,080,123 | A | * | 1/1992 | Stein | 135/97 |
| 5,240,021 | A | * | 8/1993 | Snodgrass | 135/96 |
| 5,425,753 | A | * | 6/1995 | Wege et al. | 607/83 |
| 6,665,896 | B1 | * | 12/2003 | Tseng | 5/121 |

FOREIGN PATENT DOCUMENTS

| | | | | |
|---|---|---|---|---|
| FR | 857051 | * | 8/1940 | 5/121 |
| GB | 11214 | * | 3/1899 | 5/113 |
| GB | 21109 | * | 9/1912 | 5/128 |
| GB | 203267 | * | 9/1923 | 5/128 |
| GB | 451968 | * | 8/1936 | 5/128 |

* cited by examiner

*Primary Examiner*—Robert G. Santos

(57) ABSTRACT

A stand is described for supporting a hammock, the stand having a set of two legs on each end. The two sets of legs are joined together by a covering arch which extends up and over the hammock providing shade therefor.

3 Claims, 3 Drawing Sheets

ARCHED HAMMOCK STAND

FIELD OF THE INVENTION

This invention is directed to a hammock stand which does not have perpendicular base members extending into the area adjacent the sides of the hammock, and also provides shade over the hammock.

BACKGROUND OF THE INVENTION

Hammocks were initially designed to be attached to and extended between preexisting natural supports, most commonly trees. The overhead foliage of the trees also provided shade for the hammock. But trees are often not available or appropriately positioned to support a hammock where it is needed. Trees can be planted where needed; but such trees must grow for at least twenty years to achieve a size adequate to support a hammock. Many years ago, impatient hammock fanciers conceived the idea of a hammock stand, that is a free-standing structure—the sole purpose of which is to support a hammock. Such hammock stands have been produced in a variety of forms. But generally they all include base members that are beneath and extend perpendicularly to the axis of the supported hammock. These perpendicular base members are connected to a central base member beneath the hammock and parallel to its axis. Upright stanchions are connected to opposite ends of the central base member and are supported thereby. The upright stanchions extend upwardly from the central base and provide the actual supports between which the hammock is extended.

Among the disadvantages of such hammock stands is that (unlike trees) they have no overhead foliage to provide shade for the hammock. Also, the perpendicular base members must necessarily extend substantially beyond the axis of the hammock and into the area the hammock user must traverse in the process of getting into and out of the hammock. This often results in tripping and falling or, stubbing toes.

It is, accordingly, an object of the present invention to provide an improved hammock stand which does not have perpendicular base members extending into the area adjacent the sides of the hammock. Another object of this invention is an improved hammock stand that provides shade over the hammock.

DISCLOSURE OF THE PRIOR ART

Applicant is aware of no prior art directly relevant to the present invention.

Description of a conventional hammock stand can be seen in such prior art as U.S. Pat. No. 5,153,538.

SUMMARY OF THE INVENTION

In accordance with the present invention a hammock stand has two leg members on each end. Each set of legs is wide apart at the bottom but joined at the top. The two different set of legs are joined together by an arched member which extends up and over the hammock. Because each set of legs is some distance before or behind the hammock, such legs do not extend into the area adjacent the sides of the hammock. The arched member extending up and over the hammock can be used to support a canopy to shade the hammock.

DETAILED DESCRIPTION OF THE DRAWINGS

Reference will now be made to the present preferred embodiment of the invention as illustrated in the accompanying drawings.

Figure 1:
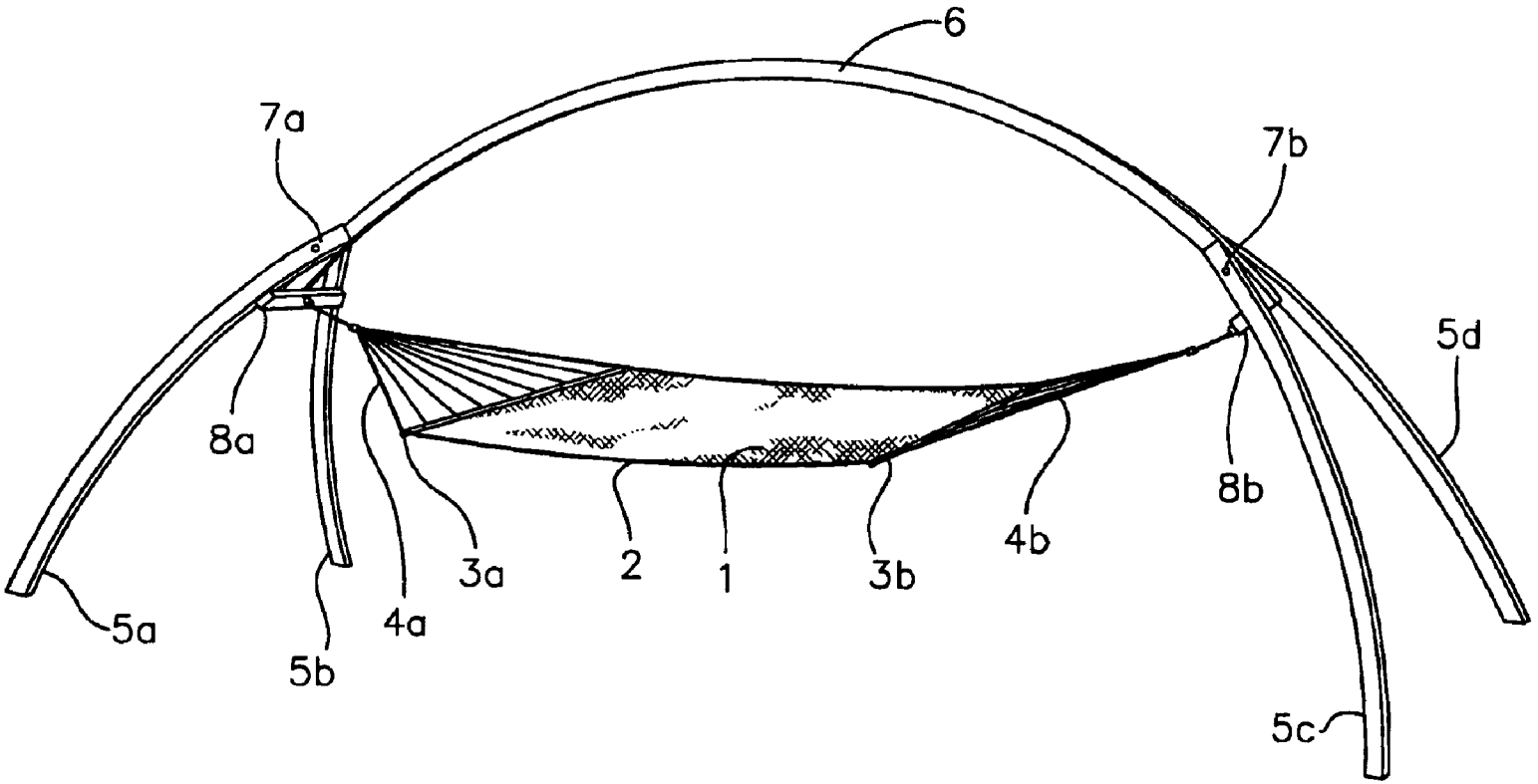
FIG. 1 is a perspective view illustrating the hammock stand of the invention without the canopy.

In FIG. 1, a hammock 1 comprises a hammock bed 2, extending between spreader bars 3*a* and 3*b*, which are supported by clews 4*a* and 4*b*. The clews 4*a* and 4*b* terminate in clew rings 10*a* and 10*b*. The hammock 1, is supported by the hammock stand, which comprises leg members 5*a*, 5*b*, 5*c* and 5*d*, the upper ends of which are joined to arch 6, by means of bolts 7*a* and 7*b*. The joint is further strengthened by the cross braces 8*a* and 8*b*, which extend across the underside of the upper ends of two leg members 5, and the proximate bottom end of arch 6. The cross braces 8*a* and 8*b* are secured by bolts to the proximate two leg members 5 and the approximate bottom end of arch 6. Extending inwardly from the cross braces 8*a* and 8*b*, are attaching hooks 9*a* and 9*b*. The clew rings 10*a* and 10*b* fit on to the attaching hooks 9*a* and 9*b*.

Figure 2:
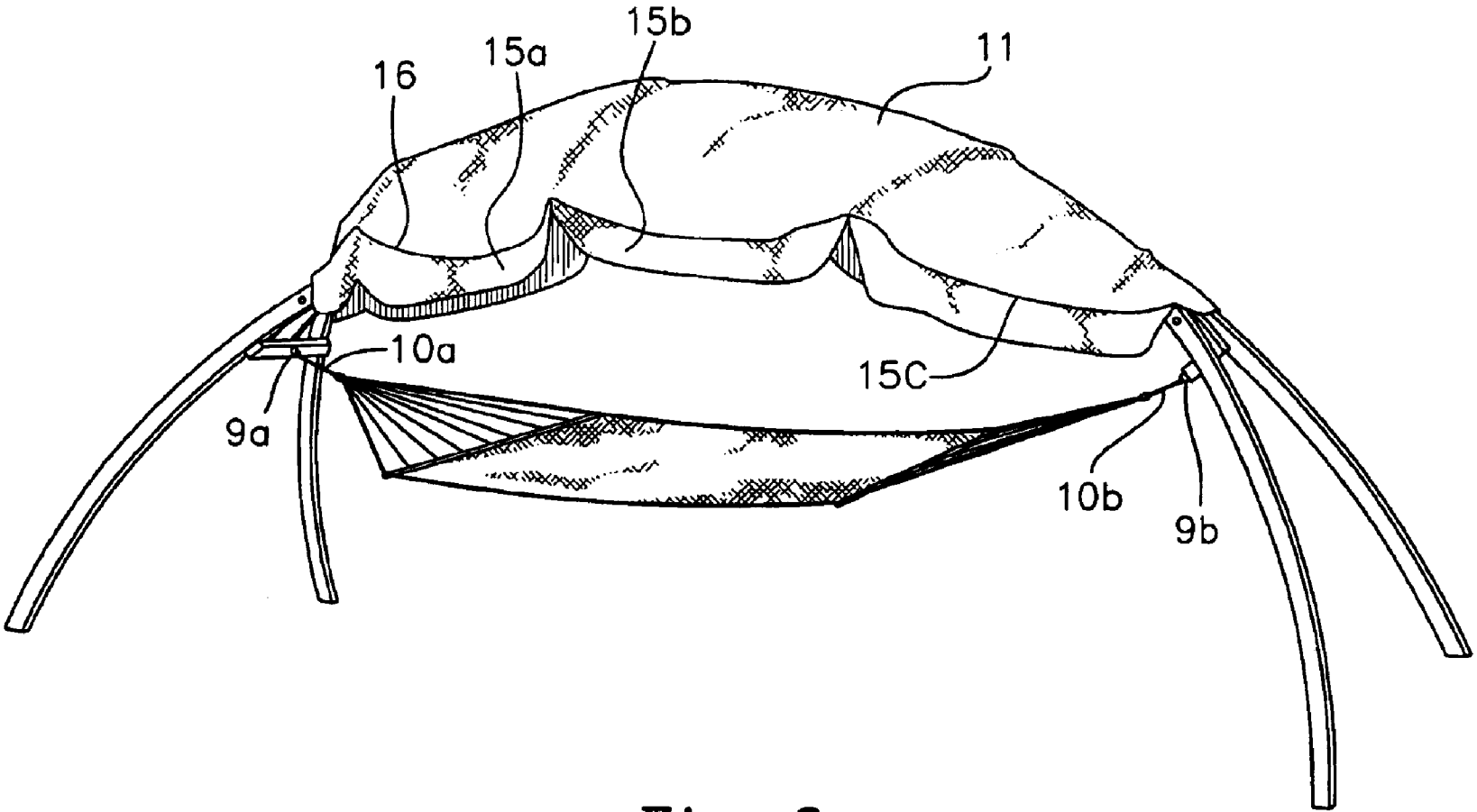
FIG. 2 is a perspective view illustrating the hammock stand of the invention with the canopy in place.
Figure 3:
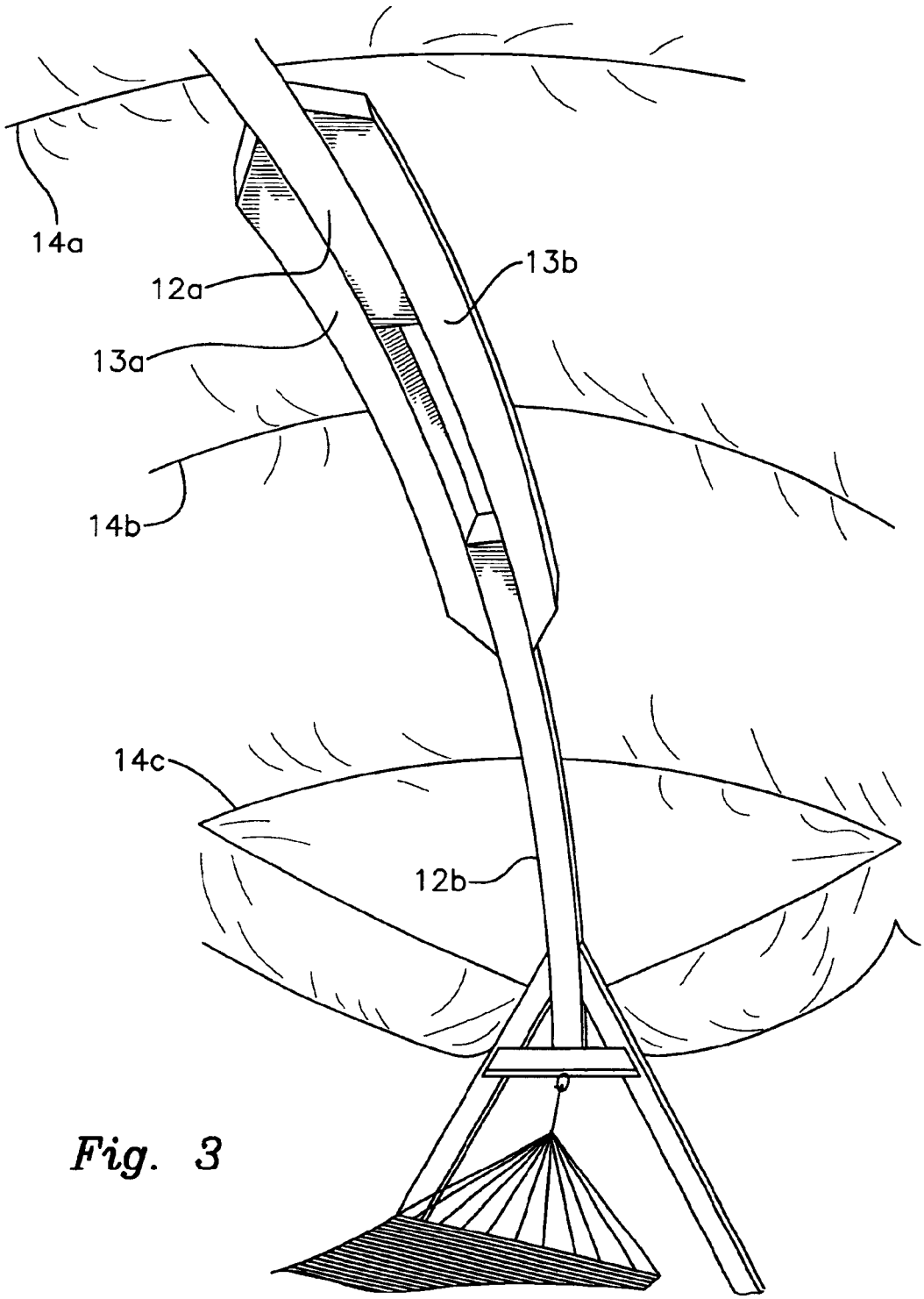
FIG. 3 is a perspective view illustrating the underside of the canopy and its supporting structure.

FIG. 2 shows the canopy 11 positioned on arch 6 and extending directly over the hammock 1. The canopy is made of flexible, lightweight, water resistant sheet material such as canvas or plastic.

From FIG. 1, it will seen that arch 6 is comprised of four wooden lengths. Arch end sections 12*a* and 12*b* are attached at their lower ends to leg members 5*a* and 5*b*, or 5*c* and 5*d*, respectively. The upper ends of sections 12*a* and 12*b*, are positioned between and affixed to arch connecting sections 13*a* and 13*b*. Forming arch 6 from the four different sections has at least two advantages. First, it is easier and less expensive than forming the arch 6 from a single piece of wood. Second, the connecting sections 13*a* and 13*b*, make the arch 6 wider at its mid section, where width is most needed because that is also where canopy 11 is widest and extends farther from the arch 6. Lateral support battens 14*a*, 14*b* and 14*c* are positioned above and supported by arch 6 and extend outwardly from it at right angles thereto. In the preferred embodiment, battens 14*a*, 14*b* and 14*c* are fiberglass, but they could be any relatively rigid but flexible material.

Around the canopy 11, and hanging down therefrom is the curtain 15. It is attached to the canopy 11, by seam 16. The curtain 15 enhances the effective shade provided by canopy 11. In the preferred embodiment, the curtain 15 is divided into three sections, 15*a*, 15*b* and 15*c*. This facilitates fabrication of the product and allows the curtain 15 to hang down from canopy 11 more evenly and without buckling.

It will be further apparent to those skilled in the art that various modifications and variations can be made in the device and method of the present invention without departing from the spirit or scope of the invention. Thus, it is intended that the present invention cover the modifications and variations of this invention provided they come within the scope of the appended claims and their equivalents.

What is claimed is:

1. A hammock stand for supporting a hammock comprising:

a covering arch, supported on each of its opposite ends by at least two leg members extending to a supporting surface; and means to attach opposite ends of a hammock to opposite ends of said covering arch and/or said adjacent leg members, said covering arch comprising unitary curved end sections, the upper ends of which are positioned between and affixed to two curved connection sections.

2. The stand of claim 1, which includes a canopy supported by said covering arch.

3. The stand of claim 2 wherein said canopy is formed of flexible sheet material suspended over battens extending perpendicularly from said covering arch.

* * * * *